United States Patent [19]

Balzer et al.

[11] 4,001,991

[45] Jan. 11, 1977

[54] STAIR NOSING STRUCTURE

[75] Inventors: Claude P. Balzer; Almer A. Reiff; Edward M. Corman, all of Wichita, Kans.

[73] Assignee: Balco, Inc., Wichita, Kans.

[22] Filed: Jan. 2, 1976

[21] Appl. No.: 646,359

[52] U.S. Cl. ..... 52/179

[51] Int. Cl.[2] ..... E04F 11/16

[58] Field of Search ..... 52/179

[56] References Cited

UNITED STATES PATENTS 3,759,000 9/1973 Balzer ..... 52/179

*Primary Examiner*—John E. Murtagh

*Attorney, Agent, or Firm*—Fishburn, Gold & Litman

[57] ABSTRACT

A stair nosing structure for a stair step having a tread surface and a riser or forwardly facing surface includes an elongated base member having spaced portions defining a channel extending along the length thereof and an elongated tread member having elongated means thereon and extending into the base member channel with an interference engagement with spaced portions of the base member including a face of one of the channel defining portions to secure the tread member to the base member.

10 Claims, 8 Drawing Figures

Fig. 1.
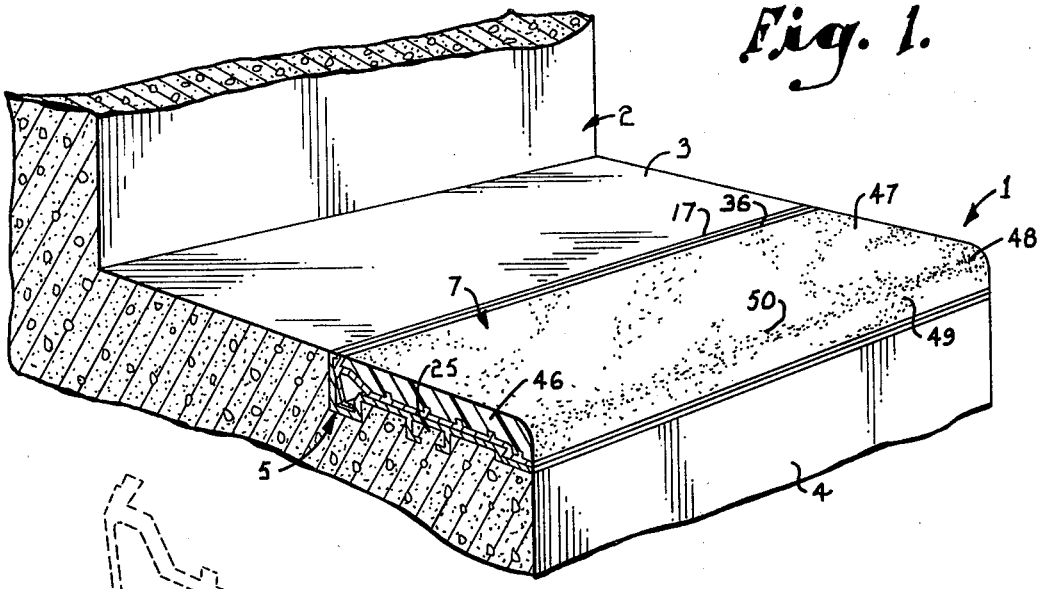
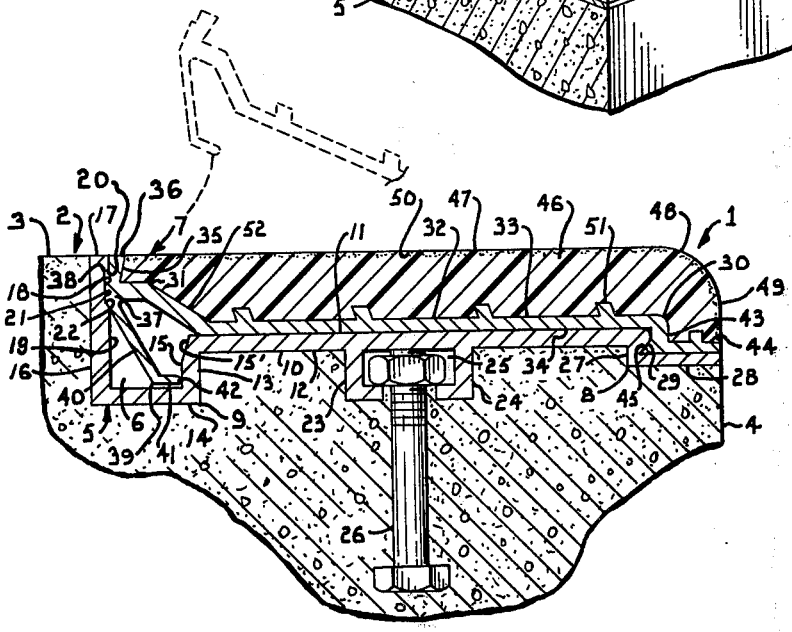
Fig. 2.
Fig. 3.
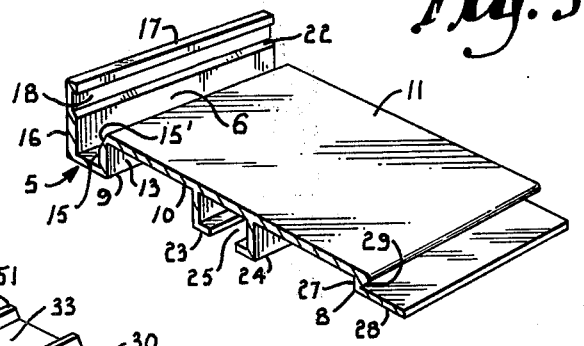
Fig. 4.
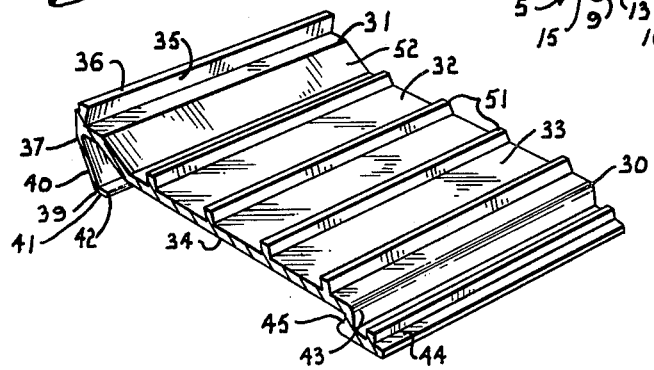

STAIR NOSING STRUCTURE

The present invention relates to stair nosing structures for stair steps and more particularly to a stair nosing structure including an elongated base member having spaced portions defining a channel extending longitudinally along the length thereof and an elongated tread member having elongated members thereon which extend into the base member channel with an interference engagement with spaced portions of the base member including a face of one of the channel defining portions to secure the tread member to the base member.

The principal objects of the present invention are: to provide a snap-on type stair nosing structure positively securing the nosing relative to a stair step; to provide such a nosing structure having a base member and a tread member having members extending therefrom with interference engagement with spaced portions of the base member to secure the tread member on the base member; to provide such a stair nosing structure having a base member and a tread member having members extending therefrom with interference engagement with spaced portions of the base member to secure the tread member on the base member; to provide such a stair nosing structure wherein the tread member is retained on the base member in a manner to prevent relative lateral movement therebetween and separation in use; to provide such a stair nosing structure wherein friction between certain engaging portions of the tread member and the base member or interengaging portions on the engaging portions of the tread member and base member produces a strong stair nosing structure characterized by absence of separation or bounce in use; to provide such a stair nosing structure having a base member to be installed in a stair tread during early stages of construction with the base member requiring a minimum of construction effort, a minimum of protection during subsequent construction operation, and providing maximum protection for the stair tread; to provide such a stair nosing structure having a base member and a tread member to be formed by extrusions; to provide such a stair nosing structure with portions of the base member defining a channel extending the length thereof and a tread member having members extending into said channel with interference engagement to secure the tread member to the base member; to provide such a stair nosing structure in which the base member and tread member have cooperating surfaces or portions that hold the tread member in place; to provide such a stair nosing structure having cooperating portions on the tread and base members for guiding the tread member into seating engagement on the base member during mounting thereof; to provide such a stair nosing structure adapted for use in on-site constructed treads and in preformed or pan-type treads; and to provide such a stair nosing structure which is economical to manufacture, is easily installed, forms an attractive and long lasting structure, and which is particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the stair nosing structure.

FIG. 1 is a partial perspective view of a stair nosing structure embodying features of the present invention and shown in place on a stair step with portions broken away to show the structure.

FIG. 2 is an enlarged transverse sectional view through the stair step and stair nosing structure with an initial position of a tread member for mounting thereof shown in broken lines.

FIG. 3 is a partial perspective view of a base member of the stair nosing structure.

FIG. 4 is a partial perspective view of a tread member of the stair nosing structure.

Figure 5:
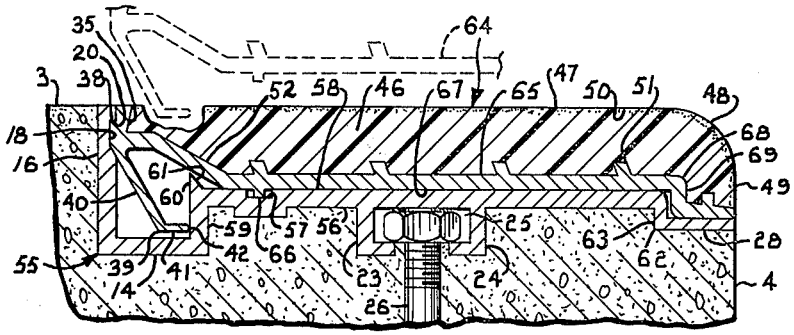
FIG. 5 is an enlarged transverse sectional view through the stair step and through a first modified stair nosing structure with an initial position of a modified tread member for mounting thereof shown in broken lines.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a stair nosing structure for a stair step 2 having a tread surface 3 and a forwardly facing riser surface 4. The stair nosing structure 1 includes an elongated base member 5 having spaced portions defining a channel 6 extending longitudinally along the length thereof and an elongated tread member 7 having elongated members or portions thereon which extend into the channel 6 of the base member 5 with an interference engagement with spaced portions of the base member 5 including a face of one of the portions defining the channel 6 to secure the tread member 7 to the base member 5. The base member 5 and the tread member 7 are particularly adapted to be formed of extrusions of metal, such as aluminum, brass, or other suitable metals.

In the structure illustrated in FIGS. 1 to 3 inclusive, the base member 5 is an elongated, relatively rigid structure adapted to be mounted on the stair step 2 adjacent the forwardly facing riser surface 4 thereof. The base member 5 has a forward edge portion 8 and a rear edge portion 9 with a body portion 10 extending therebetween. The body portion 10 has upwardly facing portions defining an upper face 11 and the body portion 10 has a lower face 12. The base member 5 has an anchor portion, as later described, adapted to be secured to the stair step 2. The base member 5 has portions defining the channel 6 which extends longitudinally along the length thereof and presents opposed faces extending from the upwardly facing portions of the body portion 10.

The illustrated channel 6 is positioned at or adjacent the rear edge portion 9 and the portions defining the channel include a first wall member 13 depending from the body portion 10 and connected to a lower body portion or an end wall 14. The first channel defining wall member 13 has an exposed face or surface 15 with an upper portion 15' thereof inclined downwardly and rearwardly from the upper face 11 of the body portion 10. The portions defining the channel 6 include a second or rear wall member 16 extending upwardly from a rear edge of the end wall 14 and having an upper edge 17 adapted to be flush or in registry with the tread surface 3 of the stair step 2.

The second wall member 16 has surfaces defining a recess 18 in an exposed face 19 thereof. The surfaces defining the recess 18 include a downwardly facing surface 20 defining a shoulder positioned adjacent the upper edge 17. A generally vertical surface 21 extends downwardly from the downwardly facing surface or shoulder 20 and terminates at a forwardly and downwardly inclined surface 22.

The base member 5 is secured to the stair step 2 in any suitable manner, such as by an anchor portion extending therein. In the illustrated structure, the base member 5 has spaced depending portions 23 and 24 defining a longitudinally extending channel or guideway 25 on the lower face 12 thereof. The depending portions 23 and 24 have facing flanges at lower edges thereof to form a reduced opening and shoulder to provide support for a plurality of longitudinally spaced anchor members 26, such as metal straps, anchor bolts, or the like, extending into a form for constructing the stair step 2.

While a guideway 25 with spaced anchor members 26 therein have been illustrated, it is to be understood that a continuous dart type anchor may be formed on the base member 5 and adapted to extend into the form for constructing the stair step 2.

The base member 5 includes means on the forward edge portion 8 thereof engageable by the tread member 7 for positioning and guiding the tread member 7 into seated position on the base member 5 during mounting of the tread member 7 on the base member 5. The forward edge portion 8 of the illustrated base member 5 has a wall member 27 depending from the body portion 10 and connected to a flange portion 28 extending forwardly therefrom. The wall member 27 has a downwardly and forwardly facing surface or shoulder 29. The flange portion 28 has an upper surface substantially parallel with the upper surface 11 of the body portion 10.

The tread member 7 of the stair nosing structure 1 is an elongated member having a forward edge portion 30 and a rear edge portion 31 and a body portion 32 extending therebetween and overlying and engaging the body portion 10 of the base member 5. The body portion 32 of the tread member 7 has an upper face 33 and a lower face 34 adapted for engaging the upwardly facing portions or upper face 11 of the base member 5.

The tread member 7 has elongated means thereon which extend therefrom and into the base member channel 6 with an interference engagement with spaced portions of the base member 5 including one of the opposed faces of the first wall member 13 and the second wall member 16 to clamp the tread member 7 to the base member 5. In the illustrated embodiment, the tread member 7 has a rear wall member 35 with an upper edge 36 thereof adapted to be flush or in registry with the upper edge 17 of the second or rear wall member 16 of the base member 5. The rear wall member 35 has an enlarged portion 37 extending rearwardly therefrom and adapted to be received in the recess 18 in the rear wall member 16 of the base member 5. The enlarged portion 37 has an upwardly facing shoulder 38 engageable with the downwardly facing shoulder 20 on the second wall member 16 of the base member 5 thereby defining cooperating portions on the rear edge portion 31 of the tread member 7 and on the second wall member 16 of the base member 5 for retaining the rear edge portion 31 of the tread member 7 in engagement with the second wall member 16 of the base member 5.

The rear edge portion 31 of the tread member 7 includes a resilient wall member or lever member 39 extending from the tread member 7 and in engagement with the first wall member 13 of the base member 5 for urging the tread member 7 into clamping engagement with the upwardly facing portions of the base member 5.

The resilient wall member or lever member 39 includes a first portion 40 extending from the rear edge portion 31 of the tread member 7 and positioned to define an acute angle between the tread member 7 and the first portion 40 of the resilient wall member 39. A second portion 41 extends from the first portion 40 of the resilient wall member 39 and has a free end edge 42 thereof in engagement with the exposed face 15 of the first wall member 13 of the base member 5. The second portion 41 is positioned to define an obtuse angle between the first portion 40 and the second portion 41 of the resilient wall member 39. The resilient member 39 preferably extends the length of the tread member and has a thickness whereby it has substantial stiffness and requires substantial force to bend same. The distance from the rear edge portion 31 to the free end edge 42 is slightly greater than the spacing between the portion of the base member engaged thereby so that when the tread member is in place in the base member, the resilient member is forced downwardly and rearwardly applying a very substantial leverage forcing the forward edge portion of the tread member downwardly into firm positive engagement with the base member.

The forward edge portion 30 of the tread member 7 includes a wall member 43 depending from the body portion 32 of the tread member 7 and connected to a flange portion 44 extending forwardly therefrom. The wall member 43 has an upwardly and rearwardly facing shoulder 45 engageable with the downwardly and forwardly facing shoulder 29 on the wall member 27 of the forward edge portion 8 of the base member 5. The flange portion 44 at the forward edge portion 30 of the tread member 7 has a lower surface engageable with the upper surface of the flange portion 28 adjacent the forward edge portion 8 of the base member 5.

The tread member 7 may be formed of a single material, such as aluminum, brass, or the like, however, it is preferred that the tread member be of different materials, as for example, a plate member of extruded material including the forward edge portion 30, body portion 32, and rear edge portion 31. The leverage member 39 is preferably integral and may be of a thickness of 1/32 inch to 1/16 inch thick with an interference permitting the tread member to be forced into assembled position by a single workman. The tread member 7 preferably includes a surface portion 46 applied and secured, as by bonding, to the plate member to form an upper tread surface 47. The tread material or surface portion 46 is applied to the plate member to cover same from the rear wall member 35 to the edge of the flange portion 44 and is formed to present a rounded nose, as at 48, and a forward or front face 49 that is in registry or flush with the forward edge of the flange portion 44. While any suitable tread material may be applied and mounted to the plate member, it is preferred that the material be a long wearing material, such as an epoxy resin with an abrasive 50 distributed therethrough with some exposed at the surface 47 to form a nonskid surface. To aid in holding the material in place, the plate member has a plurality of longitudinally extending upwardly and rearwardly inclined ribs 51 which extends into the tread material 46 and due to the incline, cooperate with an inclined portion or surface 52 of the rear edge portion 31 of the body portion 32 to aid in holding the tread material on the plate member.

During mounting of the tread member 7 on the base member 5, the free end edge 42 of the second portion 41 of the resilient wall member or lever member 39 is adapted to slide across the upper portion 15' and the exposed surface 15 of the first wall member 13 of the base member 5. The rear wall member 35 of the rear edge portion 31 of the tread member 7 is adapted to slide across an upper surface of the second or rear wall member 16 of the base member 5 in response to force on the tread member and thereby moving the shoulder 38 into engagement with the shoulder 20 and seating of the enlarged portion 37 in the recess 18. The shoulders 20 and 38 thereby are positioned in engagement which effects seating of the tread member 7 on the base member 5 and prevents separation thereof. The action of the resilient wall member 35 and the inclined portion 52 of tread member 7 in cooperation with the engagement of the shoulders 20 and 38 is effective to apply a substantial leverage or downward force to clamp the forward edge portion 30 of the tread member 7 to the forward edge portion 8 of the base member 5 and to clamp the lower face 34 of the body portion 32 of the tread member 7 in engagement with the upper face 11 of the body portion 10 of the base member 5. The forward edge portion 30 of the tread member 7 is adapted to slide across the forward edge portion 8 of the base member 5 during mounting of the tread member 7 on the base member 5. The flange portion 44 at the forward edge portion 30 of the tread member 7 is adapted to slide across the flange portion 28 at the forward edge portion of the base member 5 until the shoulders 45 and 29 are in engagement and the enlarged portion 37 is seated in the recess 18 with the free end edge 42 of the resilient wall member 39 in engagement with the exposed face 15 of the first wall member 13.

The tread member 7 may be removed and replaced after the tread material or surface portion 46 has become worn or damaged. One method would be to use a tool having an elongated sharp edge portion (not shown) adapted to be inserted between adjacent portions of the tread member 7 and the base member 5, such as between the flange portion 44 of the tread member 7 and the flange portion 28 of the base member 5. When so used, the tool would be moved to raise the tread member 7 which would distort and disengage the resilient wall member or lever member 39 of the tread member 7 from the base member 5.

A modified stair nosing structure illustrated in FIG. 5 includes a modified base member 55 which is similar to the base member 5 except a body portion 56 of the modified base member 55 has a groove or recess 57 in an upper face 58 thereof. A first wall member 59 of the channel defining portions has an upstanding rib 60 with a forwardly and upwardly facing surface 61. The first wall member 59 does not have a downwardly and rearwardly facing upper portion 15'.

A forward edge portion 62 of the modified base member 55 is similar to forward edge portion 8 of the base member 5 except a wall member 63 thereof does not have a downwardly and forwardly facing shoulder thereon. Other than the exceptions noted above, like portions of the base member 5 and the modified base member 55 are designated by the same reference numerals.

A modified tread member 64 is similar to the tread member 7 except a body portion 65 thereof has a rib 66 depending from a lower surface 67 of the body portion 65 and the rib 66 is adapted to be received in the recess or groove 57 in the upper face 58 of the modified base member 55.

A forward edge portion 68 of the modified tread member 64 is similar to the forward edge portion 30 of the tread member 7 except a wall member 69 thereof does not have an upwardly and rearwardly facing shoulder thereon. Other than the exceptions noted above, like portions of the tread member 7 and the modified tread member 64 are designated by the same reference numerals.

Cooperation between the downwardly facing shoulder 20 on the second or rear wall 16 of the modified base member 55 and the upwardly facing shoulder 38 on the rear wall member 35 of the modified tread member 64 and engagement of the free end edge 42 of the resilient wall member 39 of the modified tread member 64 with an exposed face of the first wall member 59 of the modified base member 55 is effective to clamp the modified tread member 64 to the modified base member 55 without cooperation of the shoulders on the wall members 63 and 69 of the modified base and tread members 55 and 64 respectively. The inclined portion 52 of the modified tread member 64 also cooperates with the resilient wall member 39 to clamp the modified tread member 64 to the modified base member 55.

The modified tread member 64 may also be removed and replaced, such as by a tool having an elongated sharp edge portion in a manner similar to that for the removal of the tread member 7 from the base member 5 illustrated in FIGS. 1 to 4 inclusive.

Figure 6:
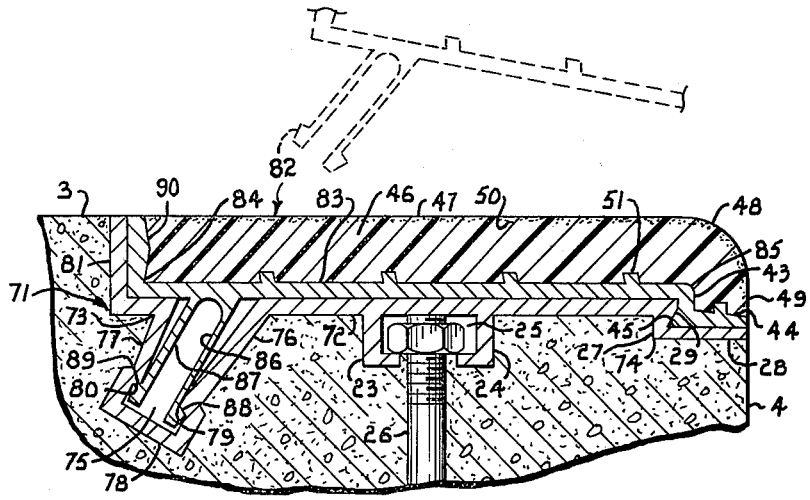
FIG. 6 is an enlarged transverse sectional view through the stair step and through a second modified stair nosing structure with an initial position of a modified tread member for mounting thereof shown in broken lines.

A second modified stair nosing structure illustrated in FIG. 6 includes a base member 71 having a body portion 72 extending between a rear edge portion 73 and a forward edge portion 74. The base member 71 also has portions defining a channel 75 extending along the length thereof and presenting opposed faces extending from upwardly facing portions thereof.

In the illustrated embodiment, laterally spaced first and second wall members 76 and 77 extend from the body portion 72 of the base members 71. The first and second wall members 76 and 77 depend from the body portion 72 and extend downwardly and rearwardly therefrom. The first and second wall members 76 and 77 are downwardly converging and are joined together at the lower ends thereof by an end wall 78.

The first or front wall members 76 has a downwardly and rearwardly facing shoulder 79 thereon and the second or rear wall member 77 has a downwardly and forwardly facing shoulder 80 thereon. The rear edge portion 73 of the base member 71 has a rear wall member 81 extending upwardly from the rear edge of the body portion 72.

The forward edge portion 74 of the base member 71 is substantially similar to the forward edge portion 8 of the base member 5 illustrated in FIGS. 1 to 3 inclusive. The forward edge portion 74 includes the wall member 27, the flange portion 28, and the shoulder 29.

The second modified stair nosing structure includes a tread member 82 adapted to be in overlying relation with the base member 71. The tread member 82 has a body portion 83 extending between a rear edge portion 84 and a forward edge portion 85. The tread member 82 has elongated members extending therefrom and extending into the base member channel 75 with interference engagement with spaced portions of the base member 71 to clamp the tread member 82 to the base member 71.

In the illustrated embodiment, first and second resilient wall members 86 and 87 extend from the body portion 83 and are in engagement with the first and second channel defining wall members 76 and 77 respectively of the base member 71. The first and second resilient wall members 86 and 87 are substantially parallel and each have an enlarged portion on a lower end thereof. The first or forward resilient wall member 86 has an upwardly and forwardly facing shoulder 88 thereon which is engageable with the downwardly and rearwardly facing shoulder 79 on the first or front wall member 76 of the base member 71. The second or rearwardly resilient wall member 87 has an upwardly and rearwardly facing shoulder 89 thereon which is engageable with the downwardly and forwardly facing shoulder 80 on the second or rear wall member 77 of the base member 71.

While first and second resilient wall members 86 and 87 have been illustrated, engagement of the first resilient wall member 86 of the tread member 82 with the first wall member 76 defining the channel 75 in the base member 71 and engagement of the respective shoulders 88 and 79 thereon is sufficient to clamp the tread member 82 onto the base member 71.

The rear edge portion 84 of the tread member 82 has a rear wall member 90 extending upwardly from the rear edge of the body portion 83. A rear face of the rear wall member 90 of the tread member 82 is in engagement with a forward face of the rear wall member 81 of the base member 71 when the tread member 82 is seated on the base member 71. The rear wall member 90 of the tread member 82 slides across the rear wall member 81 of the base member 71 during mounting of the tread member on the base member.

The forward edge portion 85 of the tread member 82 is substantially similar to the forward edge portion 30 of the tread member 70 illustrated in FIGS. 1, 2, and 4. The forward edge portion 85 also includes the wall member 43, flange portion 44, and shoulder 45. Mounting of the tread member 82 on the base member 71 is substantially similar to movement of the tread member 7 onto the base member 5.

Figure 7:
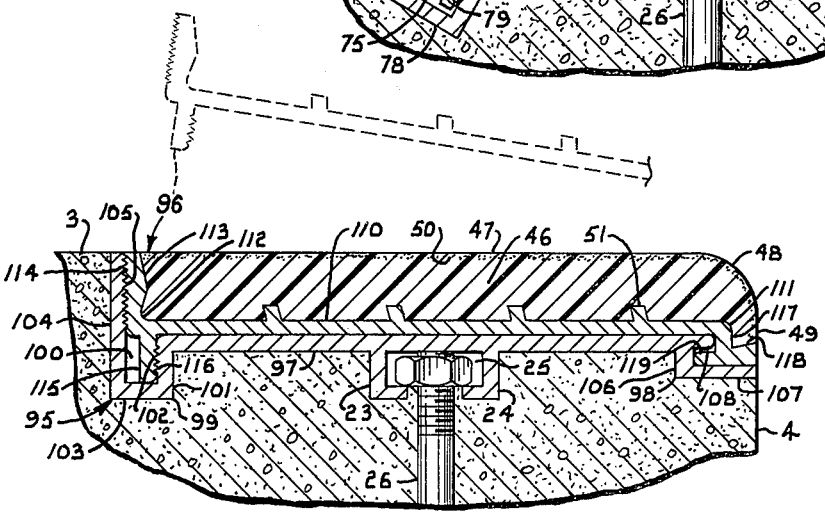
FIG. 7 is an enlarged transverse sectional view through the stair step and through a third modified stair nosing structure with an initial position of a modified tread member for mounting thereof shown in broken lines.

FIG. 7 illustrates a third modified stair nosing structure including a modified base member 95 and a modified tread member 96 overlying the base member 95. A body portion 97 of the base member 95 extends between a forward edge portion 98 and a rear edge portion 99.

The base member 95 also has portions defining a channel 100 extending along the length thereof and presenting opposed faces extending from upwardly facing portion of the base member 95. In the illustrated embodiment, a first wall member 101 of the channel defining portions depends from the body portion 97 and has a plurality of teeth 102 on an exposed face thereof. An end wall or lower body portion 103 extends rearwardly from a lower edge of the first wall member 101. A second or rear wall member 104 is laterally spaced from the first wall member 101 and extends upwardly from a rear edge of the end wall 103. The rear wall member 104 has a plurality of teeth 105 on an upper portion of a forwardly facing surface thereof.

The base member 95 and the tread member 96 have means adjacent respective forward edge portions thereof for positioning and guiding the tread member 96 into a seated position on the base member 95. The means for positioning and guiding the tread member 96 into a seated position on the base member 95 cooperate with the means to clamp the tread member 96 to the base members 95 during mounting of the tread member 96 on the base member 95.

The forward edge portion 98 of the base member 95 has a wall member 106 depending from the body portion 97 of the base member 95 and connected to a flange portion 107 extending forwardly therefrom. The body portion 97 extends forwardly beyond the wall member 107 and thereby defines a downwardly facing shoulder 108. The flange portion 107 extends forwardly from the wall member 106 and has an upper surface substantially parallel with an upper surface of the body portion 97 of the base member 95.

The rear edge portion 112 of the tread member 96 includes a wall member 115 depending from the body portion 110 and laterally spaced from the rear wall member 113. The wall member 115 has a plurality of teeth 116 on a forwardly facing surface thereof and adapted to interengage with the teeth 102 on the rearwardly facing surface of the first channel defining wall member 101 of the base member 95.

The forward edge portion 111 of the tread member 96 includes a wall member 117 depending from the body portion 110 of the tread member 96 and connected to a flange portion 118 engageable with the flange portion 107 of the base member 95. The flange portion 118 of the tread member 96 has a portion thereof extending rearwardly from the wall member 117 and defining an upwardly facing shoulder 119 engageable with the shoulder 108 of the base member 95 during mounting of the tread member 96 on the base member 95.

Figure 8:
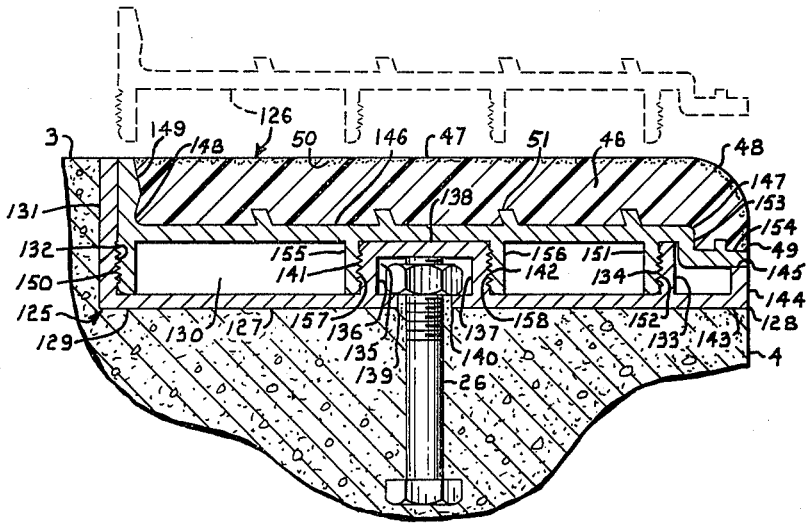
FIG. 8 is an enlarged transverse sectional view through the stair step and through a fourth modified stair nosing structure with an initial position of a modified tread member for mounting thereof shown in broken lines.

FIG. 8 illustrates a fourth modified stair nosing structure including a modified base member 125 and a modified tread member 126 overlying the base member 125. A body portion 127 of the base member 125 extends between a forward edge portion 128 and a rear edge portion 129.

The base member 125 has portions defining a channel 130 extending along the length thereof and presenting opposed faces extending from upwardly facing portions thereof. In the illustrated embodiment, the rear edge portion 129 of the base member 125 is defined by a rear wall 131 extending upwardly from a rear edge of the base member 125 and having teeth 132 on a lower portion of a forwardly facing surface thereof. The forward edge portion 128 of the base member 125 includes a wall member 133 extending upwardly from the body portion 127 and having teeth 134 on a rearwardly facing surface thereof.

The illustrated base member 125 includes a guideway 135 positioned above the body portion 127 and intermediate the edge portions of the base member 125. The guideway 135 is adapted to receive the anchor member 26 therein. Upstanding laterally spaced wall members 136 and 137 and a web member 138 define the guideway 135. The body portion 127 has opposed flange portions 139 and 140 extending from the wall members 136 and 137 to form a reduced opening and shoulders for supporting the anchor member 26. The exterior faces of the guideway wall members 136 and 137 have teeth 141 and 142 respectively thereon, for a purpose later described.

The forward edge portion 128 of the base member 125 includes a body portion extension 143 extending forwardly of the channel defining wall member 133. The forward edge portion 128 includes a forward rib or wall member 144 extending upwardly from a forward edge of the extension 143 and the rib 144 has an upper edge 145.

The tread member 126 has a body portion 146 extending between a forward edge portion 147 and a rear edge portion 148. The tread member 126 has wall members extending therefrom and each positioned in engagement with the wall members 131 and 133 respectively of the base member 125. In the illustrated embodiment, the tread member 126 has a rear wall member 149 with respective portions thereof extending above and below the body portion 146 of the tread member 126. The portion of the wall member 149 extending below the tread member body portion 146 has teeth 150 on a rearwardly facing surface thereof which are adapted to interengage with the teeth 132 on the rear wall member 131 of the base member 125.

The forward portion 147 of the tread member 126 includes a wall member 151 depending from the body portion 146 and having teeth 152 on a forwardly facing surface thereof and adapted to interengage with the teeth 134 on the rearwardly facing surface of the channel defining wall member 133 of the base member 125.

The forward portion 147 of the tread member 126 includes a depending portion 153 spaced forwardly of the wall member 151 thereby defining a downwardly open recess adapted to receive therein an upper end portion of the wall member 133 of the base member 125. The forward portion 147 of the tread member 126 includes a flange portion 154 extending forwardly from the depending portion 153 and engageable with the upper edge 145 of the forward rib 144 of the base member forward edge portion 128.

An intermediate portion of the body portion 146 of the tread member 126 includes a pair of laterally spaced wall members 155 and 156 depending therefrom and having teeth 157 and 158 on facing surfaces thereof respectively. The teeth 157 and 158 interengage with the teeth 141 and 152 respectively on the exterior surfaces of the wall members 136 and 137 defining the guideway 135.

The tread member 126 is mounted on the base member 125 by positioning the tread member 126 above the base member 125 and moving the tread member body portion 146 downwardly toward the base member body portion 127 with respective tread member wall members sliding across respective base member wall members with teeth thereon interengaging and thereby resisting upward movement of the tread member 126 in use. The recess on the tread member 126 defined by the wall member 151 and the depending portion 153 cooperates with the wall member 133 to position and guide the tread member 126 during mounting on the base member 125. Engagement of the tread member wall members 155 and 156 with the base member wall members 136 and 137 also positions and guides the tread member 126 during mounting thereof on the base member 125.

It is to be understood that while we have illustrated and described certain forms of our invention, it is not to be limited to these specific forms or arrangement of parts herein described and shown.

What we claim and desire to secure by Letters Patent is:

1. A stair nosing structure for a stair step having a tread surface, said stair nosing structure comprising:

a. an elongated relatively rigid base member adapted to be mounted on a stair step, said base member having forward and rear edge portions and upwardly facing portions and a lower face, said base member having an anchor portion adapted to be secured to the stair step, said base member having portions defining a channel extending along the length thereof and presenting opposed faces;

b. an elongated tread member having forward and rear edge portions and overlying said base member, said tread member having portions engaging upwardly facing portions of said base member;

c. elongated means on said tread member and extending therefrom and engaging said base member with an interference engagement with spaced portions of said base member including one of said opposed faces to secure said tread member to said base member;

d. said base member channel defining portions include wall members extending from said base member adjacent the rear edge portion thereof; and e. said means to secure said tread member to said base member includes:

1. cooperating portions on the rear edge portion of said tread member and on one of said wall members of said base member for retaining the rear edge portion of said tread member in engagement with said one wall member of said base member; and 2. a resilient wall member extending from said tread member and in engagement with the other of said wall members on said base member for urging said tread member into clamping engagement with said upwardly facing portions of said base member.

2. A stair nosing structure as set forth in claim 1 wherein said cooperating portions include:

a. an upwardly facing shoulder on the rear edge portion of said tread member; and b. means on said one wall member of said base member defining a downwardly facing shoulder adapted to be engaged by said upwardly facing shoulder on said tread member.

3. A stair nosing structure as set forth in claim 2 wherein said resilient wall member includes:

a. a first portion extending from the rear edge portion of said tread member and positioned to define an acute angle between said tread member and said first portion of said resilient wall member; and b. a second portion extending from said first portion and having a free end edge thereof in engagement with the other wall member of said base member, said second portion being positioned to define an obtuse angle between said first portion and said second portion of said resilient wall member.

4. A stair nosing structure as set forth in claim 3 wherein:

a. the free end edge of said second portion of said resilient wall member of said tread member is adapted to slide across a surface of the other wall member of said base member during mounting of said tread member on said base member;

b. the forward edge portion of said tread member is adapted to slide across the forward edge portion of said base member during mounting of said tread member on said base member; and c. the rear edge portion of said tread member is adapted to slide across a surface of said one wall member of said base member during mounting of said tread member on said base member.

5. A stair nosing structure for a stair step having a tread surface, said stair nosing structure comprising:

a. an elongated relatively rigid base member adapted to be mounted on a stair step, said base member having forward and rear edge portions and upwardly facing portions and a lower face, said base member having an anchor portion adapted to be secured to the stair step, said base member having portions defining a channel extending along the length thereof and presenting opposed faces;

b. an elongated tread member having forward and rear edge portions and overlying said base member, said tread member having portions engaging upwardly facing portions of said base member;

c. elongated means on said tread member and extending therefrom and engaging said base member with an interference engagement with spaced portions of said base member including one of said opposed faces to secure said tread member to said base member;

d. means adjacent the forward edge portions of said base member and said tread member for positioning and guiding said tread member into a seated position on said base member, said means for positioning and guiding said tread member into a seated position on said base member cooperating with said means to secure said tread member to said base member during mounting of said tread member on said base member;

e. said base member channel defining portions include wall members extending from said base member adjacent the rear edge portion thereof; and f. said means to secure said tread member to said base member includes:

1. cooperating portions on the rear edge portion of said tread member and on one of said wall members of said base member for retaining the rear edge portion of said tread member in engagement with said one wall member of said base member; and 2. a resilient wall member extending the length of said tread member and extending therefrom in engagement with the other of said wall members on said base member for urging said tread member into clamping engagement with said upwardly facing portions of said base member.

6. A stair nosing structure as set forth in claim 5 wherein said resilient wall member includes:

a. a first portion extending from the rear edge portion of said tread member and positioned to define an acute angle between said tread member and said first portion of said resilient wall member; and b. a second portion extending from said first portion and having a free end edge thereof in engagement with the other wall member of said base member, said second portion being positioned to define an obtuse angle between said first portion and said second portion of said resilient wall member.

7. A stair nosing structure as set forth in claim 6 wherein said cooperating means include:

a. an upwardly facing shoulder on the rear edge portion of said tread member; and b. means on said one wall member of said base member defining a downwardly facing shoulder adapted to be engaged by said upwardly facing shoulder on said tread member.

8. A stair nosing structure as set forth in claim 7 wherein:

a. the free end edge of said second portion of said resilient wall member of said tread member is adapted to slide across a surface of the other wall member of said base member during mounting of said tread member on said base member;

b. the forward edge portion of said tread member is adapted to slide across the forward edge portion of said base member during mounting of said tread member on said base member; and c. the rear edge portion of said tread member is adapted to slide across a surface of said one wall member of said base member during mounting of said tread member on said base member.

9. A stair nosing structure for a stair step havng a tread surface, said stair nosing structure comprising:

a. an elongated relatively rigid base member adapted to be mounted on a stair step, said base member having forward and rear edge portions and upwardly facing portions and a lower face, said base member having an anchor portion adapted to be secured to the stair step, said base member having portions defining a channel extending along the length thereof and presenting opposed faces;

b. an elongated tread member having forward and rear edge portions and overlying said base member, said tread member having portions engaging upwardly facing portions of said base member;

c. elongated means on said tread member and extending therefrom and engaging said base member with an interference engagement with spaced portions of said base member including one of said opposed faces to secure said tread member to said base member;

d. means adjacent the forward edge portions of said base member and said tread member for positioning and guiding said tread member into a seated position on said base member, said means for positioning and guiding said tread member into a seated position on said base member cooperating with said means to secure said tread member to said base member during mounting of said tread member on said base member, said means for positioning and guiding said tread member into seated position on said base member includes:

1. a wall member depending from said base member and having a downwardly facing shoulder thereon; and
2. a wall member depending from said tread member and having an upwardly facing shoulder thereon and adapted to engage and slide across said downwardly facing shoulder on said base member during mounting of said tread member on said base member;

e. said base member channel defining portions include wall members extending from said base member adjacent the rear edge portion thereof; and f. said means to secure said tread member to said base member includes:

1. cooperating portions on the rear edge portion of said tread member and on one of said wall members of said base member for retaining the rear edge portion of said tread member in engagement with said one wall member of said base member; and
2. a resilient wall member extending from said tread member and in engagement with the other of said wall members on said base member for urging said tread member into clamping engagement with said upwardly facing portions of said base member;

g. said cooperating portions include:

1. an upwardly facing shoulder on the rear edge portion of said tread member; and
2. means on said one wall member of said base member defining a downwardly facing shoulder adapted to be engaged by said upwardly facing shoulder on said tread member; and h. said resilient wall member includes:

1. a first portion extending from the rear edge portion of said tread member and positioned to define an acute angle between said tread member and said first portion of said resilient wall member; and
2. a second portion extending from said first portion and having a free end edge thereof in engagement with the other wall member of said base member, said second portion being positioned to define an obtuse angle between said first portion and said second portion of said resilient wall member.

10. A stair nosing structure for a stair step having a tread surface, said stair nosing structure comprising:

a. an elongated relatively rigid base member adapted to be mounted on a stair step, said base member having forward and rear portions and an upwardly facing intermediate portion and a lower face, said base member having an anchor portion adapted to be secured to the stair step, said base member having portions adjacent the rear thereof defining a channel extending along the length thereof and presenting opposed faces;

b. the forward portion of said base member having an upwardly facing surface offset downwardly from said intermediate upwardly facing portion with said forward portion connected to said intermediate portion by a wall having a downwardly facing ledge, said upwardly facing surface of said forward portion extending from said wall under said ledge to a forward edge of the base member;

c. an elongated tread member having forward and rear portions and overlying said base member, said tread member having portions engaging upwardly facing portions of said base member, said tread member having a forward portion offset downwardly and slidably engaged with said upwardly facing surface of the forward portion of the base member and a rearwardly extending shoulder portion engaging under said ledge; and d. elongated means on said tread member adjacent the rear portion thereof and extending therefrom and having interference engagement with portions of said base member defining said channel including one of said opposed faces to urge the tread member rearwardy for maintaining engagement of the shoulder and ledge at the downwardly offset portions of the base and tread members and cooperate therewith to secure the tread member to the base member.

* * * * *